US005109688A

United States Patent [19]

King

[11] Patent Number: 5,109,688

[45] Date of Patent: May 5, 1992

[54] ROLLING MILL

[75] Inventor: Timothy E. King, Telford, United Kingdom

[73] Assignee: Rollsec Limited, West Midlands, United Kingdom

[21] Appl. No.: 699,881

[22] Filed: May 14, 1991

[30] Foreign Application Priority Data

May 18, 1990 [GB] United Kingdom ..... 9011225

[51] Int. Cl.[5] ..... B21B 31/14

[52] U.S. Cl. ..... 72/180; 72/176; 72/226; 72/238; 72/181

[58] Field of Search ..... 72/181, 180, 176, 226, 72/238, 239, 249

[56] References Cited

U.S. PATENT DOCUMENTS

| | | | |
|---|---|---|---|
| 494,904 | 4/1893 | Story | 72/238 |
| 1,936,228 | 11/1933 | Crafton | 72/180 |
| 3,318,130 | 5/1967 | Sendzimir | 72/238 |
| 3,453,852 | 7/1969 | Valente | 72/239 |
| 4,136,545 | 1/1979 | Wilson | 72/226 |
| 4,903,516 | 2/1990 | Olsson | 72/226 |
| 4,974,435 | 12/1990 | Vandenbroucke | 72/249 |

FOREIGN PATENT DOCUMENTS

| | | | |
|---|---|---|---|
| 2816993 | 10/1979 | Fed. Rep. of Germany | 72/226 |

*Primary Examiner*—Daniel C. Crane

*Attorney, Agent, or Firm*—Marshall, O∝Toole, Gerstein, Murry & Bicknell

[57] ABSTRACT

A rolling mill comprising a plurality of roll passes for progressively forming a workpiece to a desired final cross-sectional shape wherein each roll pass comprises a pair of rotatable mountings, the mountings being disposed on opposite sides of a pass line of the mill, each rotatable mounting carrying at least two rolling means of different configuration to form the workpiece to a difference final shape and rotation of the mounting permitting a selected rolling means of each mounting to be disposed, at a rolling position, on opposite sides of said pass line to engage and form the workpiece and wherein the mill has a drive means to rotate at least one rolling means of at least one of said roll passes when disposed in said rolling position.

17 Claims, 4 Drawing Sheets

FIG 3
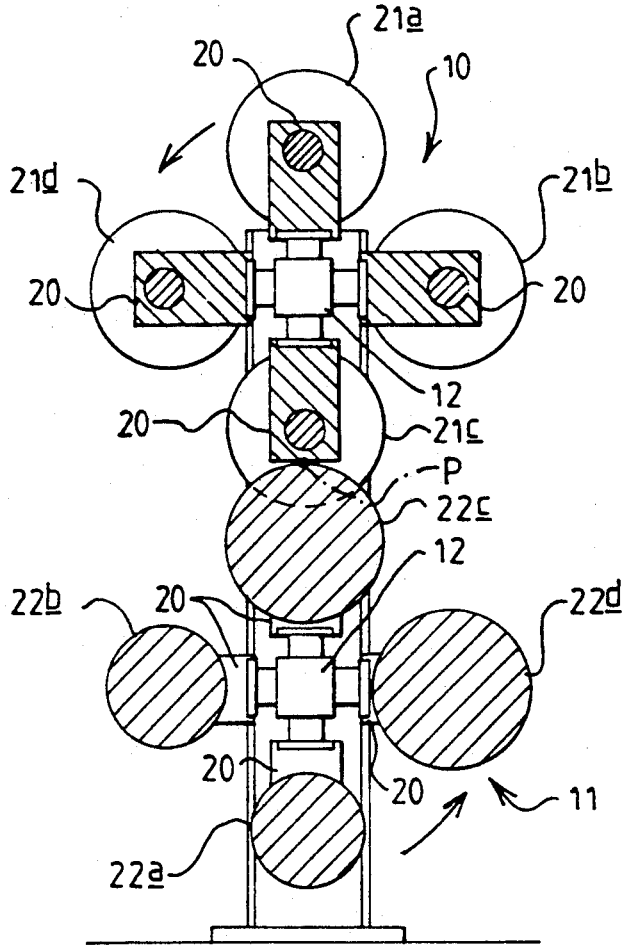
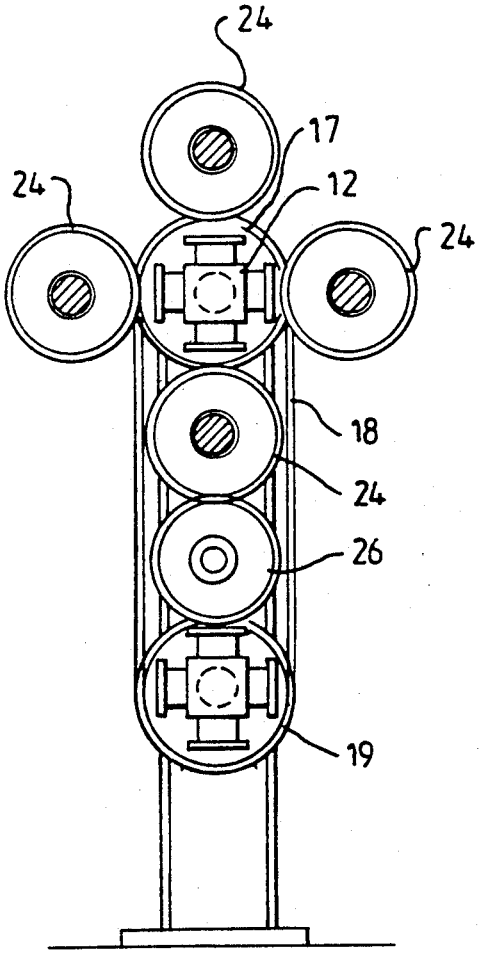
FIG 4

ROLLING MILL

BACKGROUND OF THE INVENTION

This invention relates to a rolling mill comprising a plurality of roll passes for progressively forming a work piece to a desired final cross-sectional shape.

An object of the invention is to provide such a rolling mill whereby the final cross-sectional shape can be readily changed.

SUMMARY OF THE INVENTION

According to the present invention we provide a rolling mill comprising a plurality of roll passes for progressively forming a workpiece to a desired final cross-sectional shape wherein each roll pass comprises a pair of rotatable mountings, the mountings being disposed on opposite sides of a pass line of the mill, each rotatable mounting carrying at least two rolling means of different configuration to form the workpiece to a different final shape and rotation of the mountings permitting a selected rolling means of each mounting to be disposed, at a rolling position, on opposite sides of said pass line to engage and form the workpiece and wherein the mill has a drive means to rotate at least one rolling means of at least one of said roll passes when disposed in said rolling position.

Preferably the workpiece is advanced through the rolling mill by virtue of driving engagement between the workpiece and the or each driven rolling means of said at least one roll pass.

Preferably, said drive means comprises, at said at least one roll pass, a drive shaft and coupling means to couple the drive shaft to a first rolling means carried by one of said mountings when at its rolling position.

The coupling means may couple the drive shaft to the first rolling means when the rolling means is at its rolling position and un-couple the drive shaft from the first rolling means when the rolling means is spaced from its rolling position.

The coupling means may comprise a pair of gears, one driven from the drive shaft and the other driving said first rolling means and which are brought into meshing engagement as the first rolling means is brought to its rolling position.

At said at least one roll pass, each rolling means carried by one of said mountings may have a driven gear connected thereto, the driven gear of each rolling means of said one mounting being moved into mesh with the driving gear connected to said drive shaft when said rolling means are moved into their respective rolling positions.

Transmission means may be provided to transmit rotation from said first rolling means to a second rolling means carried by the other of said mountings when at its rolling position.

The transmission means may comprise a further pair of meshing gears, one driven with the first rolling means and the other driving said second rolling means.

At said at least one roll pass, each rolling means carried by one of said mountings may have a driving gear and a driven gear connected thereto, each rolling means carried by the other of said mountings having a driven gear connected therewith, the driven gear of the rolling means of said one mounting being moved into mesh with the driving gear connected to said drive shaft and the driving gear of said rolling means of said one mounting being moved into mesh with the driven gear of a rolling means of said other mounting, when said rolling means are moved into their respective rolling positions.

The drive shaft of each roll pass may be driven from a common main drive shaft via a respective gear box.

Each rolling means may extend transversely of the pass line of the mill to act on a workpiece at a plurality of spaced positions transversely thereof to form a plurality of corrugations therein.

Each rolling means may comprise a plurality of circumferentially extending recesses and ribs, the ribs and recesses of one rolling means being disposed opposite the recesses and ribs respectively of the other rolling means when in said rolling position to shape the workpiece by free forming.

Each rolling means may comprise a plurality of axially disposed components adapted to rotate together.

The rotatable mountings at each pass may be interconnected so that the rotatable mountins rotate in a predetermined relationship.

The rotatable mountings may be inter-connected by an endless loop such as a chain looped round a sprocket provided on each mounting.

Means may be provided to lock the mountings in alternate positions whereby each rolling means may be locked in said rolling position.

The mountings may each comprise a beam extending between and rotatably supported by a pair of stands, the beams having a plurality of sets of radially extending arms by which said rolling means are rotatably carried.

The first rolling means may be the upper rolling means.

The first rolling means may be the lower rolling means.

Means may be provided to permit of adjustment of the spacing between the rotatable mountings of said pair of rotatable mountings.

BRIEF DESCRIPTION OF THE DRAWINGS

Two embodiments of the invention will now be described by way of example with reference to the accompanying drawings wherein:

FIG. 3 is a section on the line 3—3 of FIG. 2,

FIG. 4 is a section on the line 4—4 of FIG. 2, and

DESCRIPTION OF THE PREFERRED EMBODIMENTS

Figure 1:
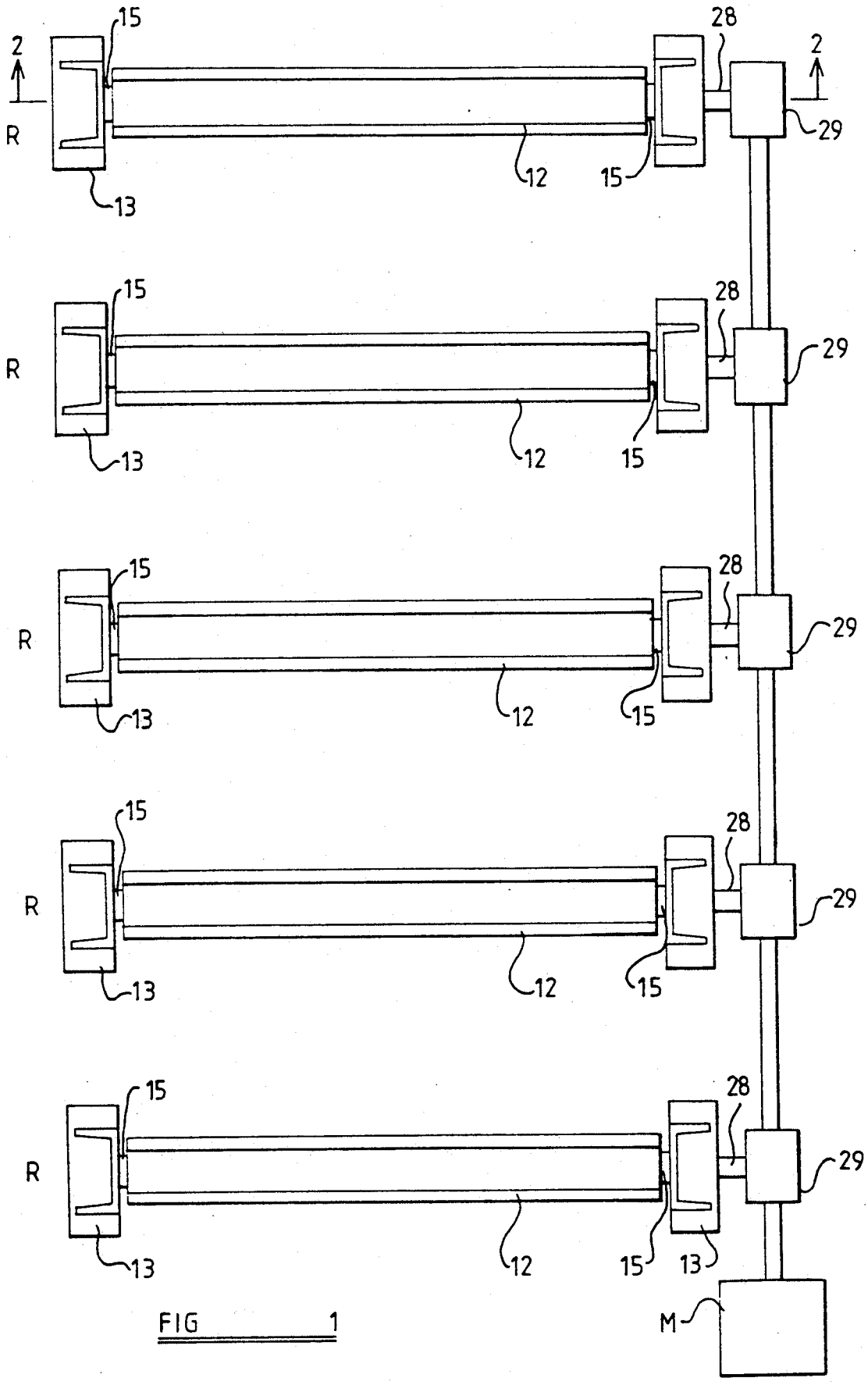
FIG. 1 is a diagrammatic plan view of a rolling mill embodying the invention with the rolling means omitted for clarity.
Figure 2:
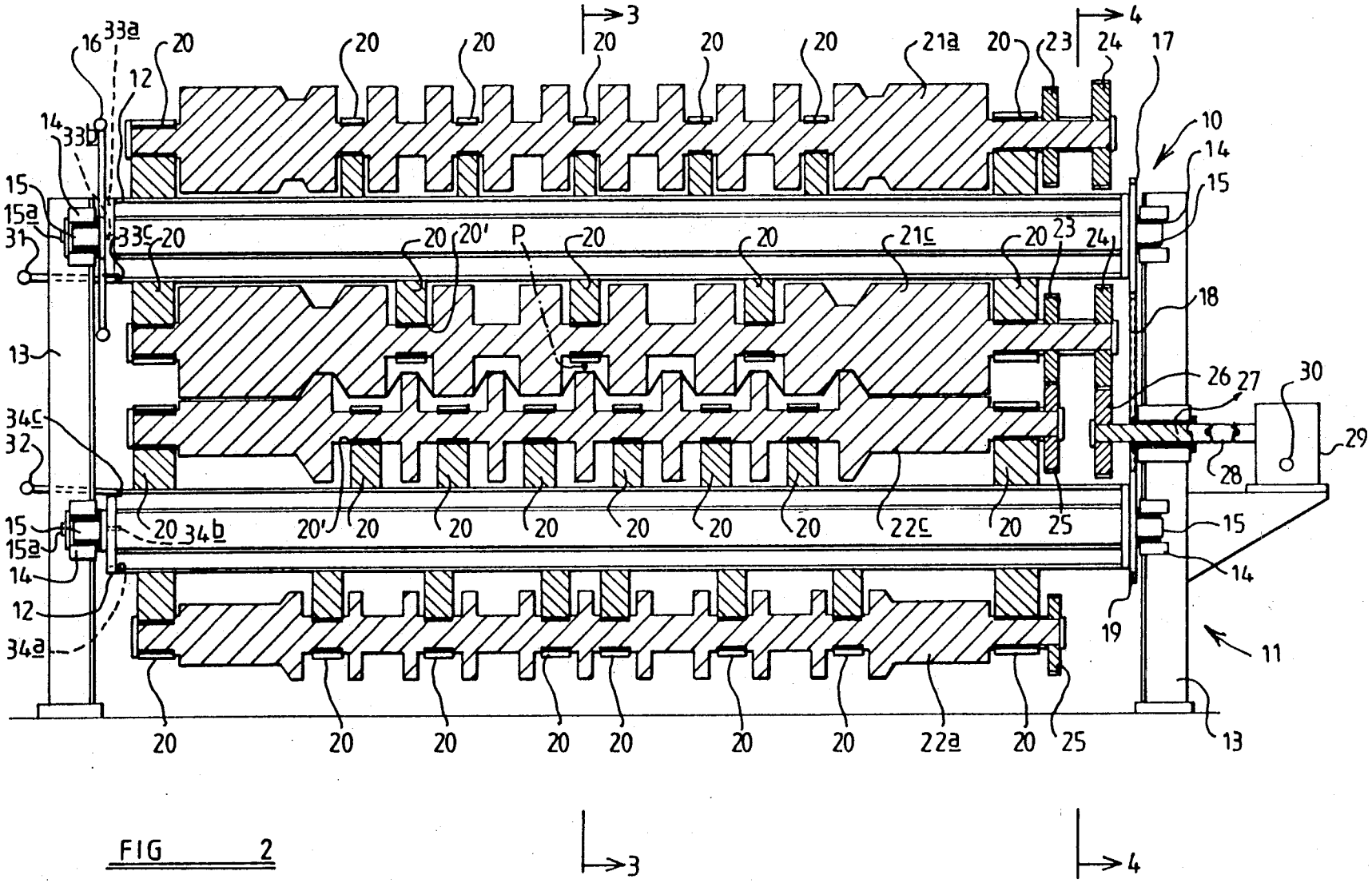
FIG. 2 is a cross-section on the line 2—2 of FIG. 1.

Referring to FIGS. 1 to 4 of the drawings, a rolling mill embodying the invention, comprises a plurality of roll passes for progressively forming a workpiece to a desired final cross-sectional shape. The number of passes is determined in accordance with conventional rolling mill practice. In the present example five roll passes are provided, although any suitable number of passes may be provided. Each pass is of the same construction as the final pass which is illustrated in FIGS. 2–4 except for the profile of the rolls which vary progressively through the mill in accordance with conventional rolling mill practice so as to progressively form an initially planar workpiece of strip of metal such as steel or aluminum to a desired final cross-sectional shape.

Each roll pass comprises a pair of rotatable mountings 10, 11 disposed on opposite sides of a pass line P of the mill. Each rotatable mounting 10, 11 comprises a fabricated beam 12 of square cross-sectional shape which is supported at its opposite ends by stands 13 disposed on opposite sides of the mill and rotatably mounted thereon by bearings 14 in which stub axles 15 projecting from the beams 12 are rotatably received. The beams 12 are disposed vertically one above the other and the upper beam is provided with a hand wheel 16 by which the beam can be rotated. At its opposite end the upper beam 16 is provided with a sprocket 17 around which a chain 18 is entrained and the chain 18 is also entrained around a further sprocket 19 fixed to the adjacent end of the lower beam 12 so that rotation of the upper beam 12 by the hand wheel 16 is transmitted to the lower beam 12 so that the beams rotate through equal angular extents.

Each beam 12 has a plurality of radially extending arms 20 on each of the four faces of the beam. The number and disposition of the radial arms 20 on each face is determined in accordance with the profile of a rolling means 21*a–d*, 22*a–d* to be supported thereby.

If desired, the beam 12 may have a different number of faces, (more or less than four) thus providing a different number of alternative profiles.

Each rolling means 21*a–d* is arranged to co-operate with a rolling means 22*a–d* respectively to form the workpiece to the desired cross-sectional configuration at the rolling pass concerned.

The radial arms 20 are provided with suitable bearing means 20' whereby the rolling means 21*a–d*, 22*a–d* are rotatably carried thereby.

Each rolling means 21*a–d* of the upper mounting 10 is provided with a driving gear 23 and a driven gear 24 whilst each rolling means 22*a–d* is provided with a driven gear 25 alone. The driving gear 23 and the driven gear 25 are brought into meshing engagement when an associated rolling means 21*a–d*, 22*a–d* respectively is brought into rolling position such as is occupied by the rolling means 21*c*, 22*c* shown in FIG. 2.

In addition the driven gear 24 of each rolling means 21*a–d* is brought into meshing engagement with the driving gear 26 when the rolling means 21*a–d* is brought into said rolling position.

The driving gear 26 is driven by a drive shaft 27 which is itself driven via a universally jointed intermediate shaft 28 from a gear box 29. The gear box 29 is driven from a common drive or lay shaft 30 which extends longitudinally of the mill to drive the gear boxes 29, one at each roll pass, from a motor M.

A peg 31, 32 is provided to be engaged in a slot 33*a–d*, 34*a–d* provided at one end of each face of each beam 12 so as to permit each beam 12 to be locked in a selected one of four different angular positions to hold a respective rolling means 21*a–d*, 22*a–d* in their rolling position.

In the present example each rolling means 21*a–d*, 22*a–d* is machined from a solid cylinder to provide the desired configuration. However, if desired, each rolling means may be made from a plurality of components disposed longitudinally of the rolling means and clamped together by suitable means so as to rotate as a unit.

By rotating the hand wheel 16 a desired pair of rolling means 21*a–d*, 22*a–d* are brought into rolling position to form the workpiece to a desired final configuration. When it is desired to produce a workpiece of a different final configuration it is simply necessary to release the locking pegs 31, 32 and rotate the hand wheel 16 to bring a different pair of rolling means 21*a–d*, 22*a–d* into rolling position. A clamping bolt 15*a* of each beam is preferably then tightened to further secure the beams in position. Thus the rolling mill can be easily and conveniently changed to produce any one of the available different final workpiece configuration, i.e. four in the illustrated example.

If desired, the driving gear 26 may be arranged to mesh with a driven gear of the rolling means of the lower mounting 11 instead of a driven gear of the upper mounting 10 as described hereinbefore.

Figure 5:
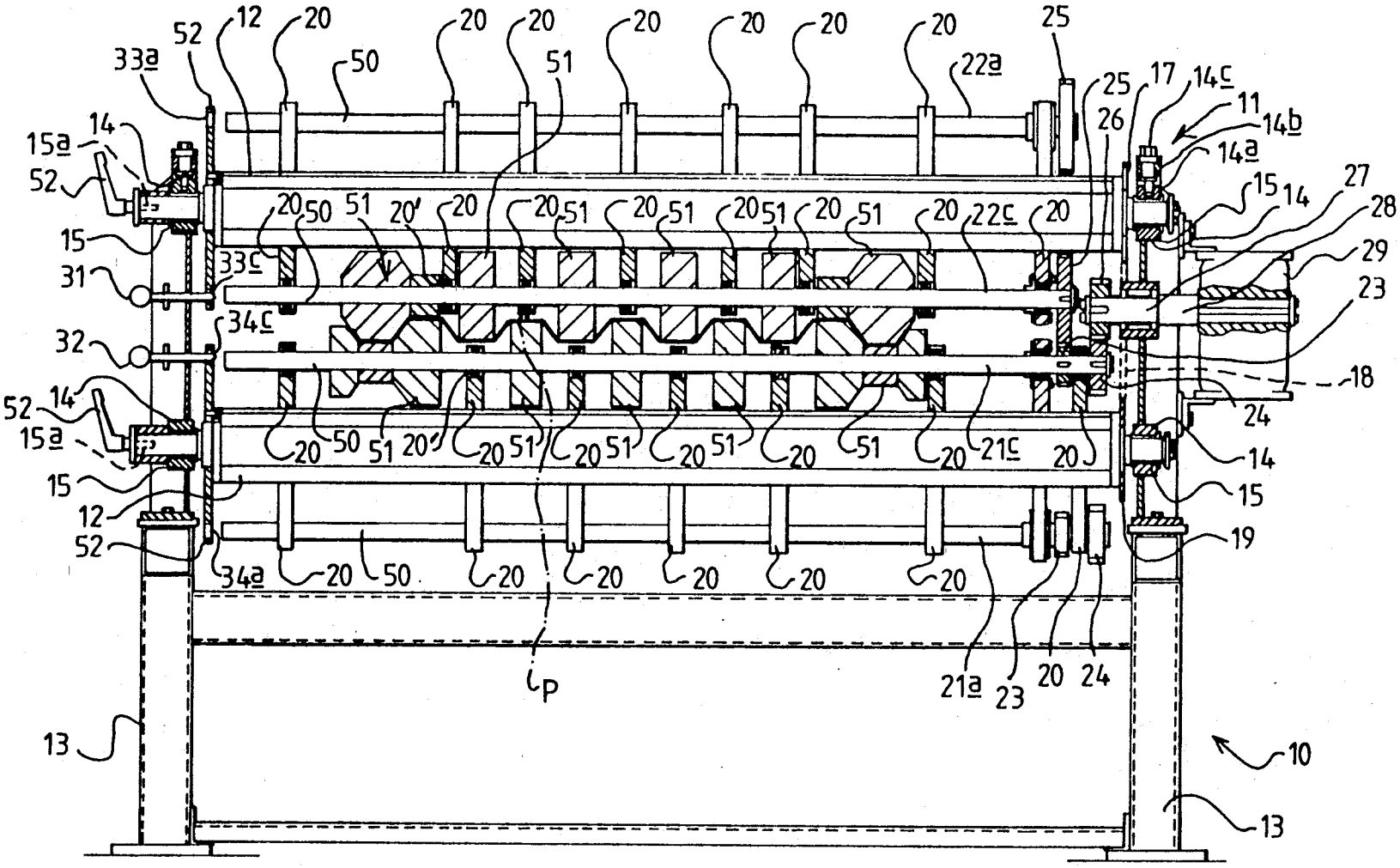
FIG. 5 is a cross-section similar to that of FIG. 2 but of another embodiment of the invention and with parts omitted.

FIG. 5 illustrates another embodiment of the invention. In FIG. 5 the same reference numerals are used as are used in FIGS. 1–4 to refer to corresponding parts except that the upper mounting 10 and the upper rolling means 21*a–d* in FIGS. 1–4 are referred to as 11 and 22*a–d* respectively in FIG. 5 whilst the lower mounting 11 and lower rolling means 22*a–d* of FIGS. 1–4 are referred to as 10 and 21*a–d* respectively in FIG. 5. The embodiment shown in FIG. 5 is essentially similar to that illustrated in FIGS. 1–4 except as described hereinafter and as will be seen by comparing FIG. 5 with FIGS. 1–4.

In the embodiment of FIG. 5 each rolling means 21*a–d*, 22*a–d* comprises a longitudinally extending shaft 50 which is supported for rotation in the bearings 20' of the radial arms 20. Each shaft 50 carries a plurality of discrete roll elements 51 which may be single or multi-component members. The discrete roll elements 51 are secured to the shafts 21*c* by grub screws or in any other conventional manner. As in the first embodiment elements 51 of appropriate shape are provided on all the shafts 21*a–d* to suit the section being manufactured. The FIG. 5 the rolling elements are not shown on the shaft 21*a*–22*a* for convenience.

In the embodiment of FIG. 5, the gear box 29 is mounted at a higher level than in the embodiment of FIGS. 1–4 and the driving gear 26 meshes with a driven gear 24 of a rolling means 21*a–d* of the lower mounting 10 instead of a driven gear of the upper mounting as in FIGS. 1–4. Each rolling means 21*a–d* of the lower mounting 10 is provided with a driving gear 23, as well as the driven gear 24 which is arranged to mesh with the driving gear 26. Each upper rolling means 22*a–d* is provided with a driven gear 25 alone which is brought into meshing engagement with the driving gear 23 when the associated rolling means 21*a–d*, 22*a–d* respectively is brought into rolling position such as is occupied by the rolling means 21*c*, 22*c* shown in FIG. 5.

In both embodiments the lowermost parts of the section at each roll pass lies in a common horizontal plane so that as the sheet is progressively formed it is effectively progressively deformed upwardly from an original flat sheet lying in the horizontal plane. It is preferred to drive the lower of each pair of rolls at each roll pass as illustrated in FIG. 5.

In this embodiment components corresponding to the clamping bolts 15*a* are provided but in this case have levers 52 fixed thereto for ease of tightening.

In this embodiment instead of the upper beam being provided with a handwheel 16 the lower beam is provided with a lever, not shown, to permit manual rotation of the lower beam and hence of the upper beam through the socket 17, 19 and chain 18.

The upper beam 12 has the bearings 14 carried in blocks 14*a* which can be adjusted up and down in guideways 14*b* under the control of screw threaded adjusters 14*c* to vary the spacing of the rolling means 21*a–d*, 22*a–d*.

In either embodiment, if desired, a transmission means to transmit drive from the roll of the upper mounting 10, or lower mounting 11, to the rolls of the lower mounting 11, or upper mounting 10, respectively may be omitted. In this case the workpiece is advanced through the mill solely by frictional engagement thereof by the respective upper or lower driven forming rolling means.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. A rolling mill comprising:

a plurality of roll passes for progressively forming a workpiece to a desired final cross-sectional shape wherein each roll pass comprises a pair of rotatable mountings, the mountings being disposed on opposite sides of a pass line of the mill;

each rotatable mounting carrying at least two rolling means of different configuration to form the workpiece to a different final shape and rotation of the mountings permitting a selected rolling means of each mounting to be disposed, at a rolling position, on opposite sides of said pass line to engage and form the workpiece;

the mill having a drive means to rotate at least one rolling means of at least one of said roll passes when disposed in said rolling position;

the drive means comprising, at said at least one roll pass, a drive shaft and coupling means to couple the drive shaft to a first rolling means carried by one of said mountings when at its rolling position;

the coupling means coupling the drive shaft to the first rolling means when the rolling means is at its rolling position and un-coupling the drive shaft from the first rolling means when the rolling means is spaced from its rolling position;

the coupling means comprising a pair of gears, one driven from the drive shaft and the other driving said first rolling means and which are brought into meshing engagement as the first rolling means is brought to its rolling position;

at said at least one roll pass, each rolling means carried by one of said mountings having a driven gear connected thereto, the driven gear of each rolling means of said one mounting being moved into mesh with the driving gear connected to said drive shaft when said rolling means are moved into their respective rolling positions; and transmission means to transmit rotation from said first rolling means to a second rolling means carried by the other of said mountings when at its rolling position.

2. A rolling mill according to claim 1 wherein the drive shaft of each roll pass is driven from a common main drive shaft via a respective gear box.

3. A rolling mill according to claim 1 wherein the workpiece is advanced through the rolling mill by virtue of driving engagement between the workpiece and the or each driven rolling means of said at least one roll pass.

4. A rolling mill according to claim 1 wherein the transmission means comprises a further pair of meshing gears, one driven with the first rolling means and the other driving said second rolling means.

5. A rolling mill according to claim 4 wherein at said at least one roll pass, each rolling means carried by one of said mountings has a driving gear and a driven gear connected thereto, each rolling means carried by the other of said mountings having a driven gear connected therewith, the driven gear of the rolling means of said one mounting being moved into mesh with the driving gear connected to said drive shaft and the driving gear of said rolling means of said one mounting being moved into mesh with the driven gear of a rolling means of said other mounting, when said rolling means are moved into their respective rolling positions.

6. A rolling mill according to claim 5 wherein the drive shaft of each roll pass is driven from a common main drive shaft via a respective gear box.

7. A rolling mill according to claim 1 wherein each rolling means extends transversely of the pass line of the mill to act on a workpiece at a plurality of spaced positions transversely thereof to form a plurality of corrugations therein.

8. A rolling mill according to claim 7 wherein each rolling means comprises a plurality of circumferentially extending recesses and ribs, the ribs and recesses of one rolling means being disposed opposite the recesses and ribs respectively of the other rolling means when in said rolling position to shape the workpiece.

9. A rolling mill according to claim 1 wherein each rolling means comprises a plurality of axially disposed components adapted to rotate together.

10. A rolling mill according to claim 1 wherein the rotatable mountings at each pass are inter-connected so that the rotatable mountings rotate in a predetermined relationship.

11. A rolling mill according to claim 10 wherein the rotatable mountings are inter-connected by an endless loop.

12. A rolling mill according to claim 1 wherein means are provided to lock the mountings in alternate positions whereby each rolling means may be locked in said rolling position.

13. A rolling mill according to claim 1 wherein the mountings each comprise a beam extending between and rotatably supported by a pair of stands, the beams having a plurality of sets of radially extending arms by which said rolling means are rotatably carried.

14. A rolling mill according to claim 1 wherein the first rolling means is the upper rolling means.

15. A rolling mill according to claim 1 wherein the first rolling means is the lower rolling means.

16. A rolling mill according to claim 1 wherein means are provided to permit of adjustment of the spacing between the rotatable mountings of said pair of rotatable mountings.

17. A rolling mill according to claim 4 wherein the drive shaft of each roll pass is driven from a common main drive shaft via a respective gear box.

* * * * *